US006247412B1

(12) United States Patent
Vornfett

(10) Patent No.: US 6,247,412 B1
(45) Date of Patent: Jun. 19, 2001

(54) ELECTRIC CONTACT ASSEMBLY FOR A CARTRIDGE TO BE FIRED FROM A WEAPON BARREL

(75) Inventor: Karl-Ulrich Vornfett, Unterlüss (DE)

(73) Assignee: TZN Forschungs- und Entwicklungs-zentrum, Unterlüss (DE)

( * ) Notice: Subject to any disclaimer, the term of this patent is extended or adjusted under 35 U.S.C. 154(b) by 0 days.

(21) Appl. No.: 09/443,318

(22) Filed: Nov. 19, 1999

(30) Foreign Application Priority Data

Nov. 19, 1998 (DE) ..... 198 53 290

(51) Int. Cl.[7] ..... F42B 5/26

(52) U.S. Cl. ..... 102/472; 102/469; 102/470; 102/472

(58) Field of Search ..... 102/469, 470, 102/472

(56) References Cited

U.S. PATENT DOCUMENTS 3,009,419 * 11/1961 Clay, Jr. et al. ..... 120/472
5,421,264 * 6/1995 Petrick ..... 102/472
6,131,519 * 10/2000 Thiesen et al. ..... 102/469

FOREIGN PATENT DOCUMENTS 20 59 665 6/1972 (DE) .
0729372 A1 * 5/1955 (GB) ..... 102/472

* cited by examiner

*Primary Examiner*—Michael J. Carone
*Assistant Examiner*—Lulit Semunegus
(74) *Attorney, Agent, or Firm*—Venable; Gabor J. Kelemen

(57) ABSTRACT

An electric contact assembly in combination with a cartridge to be fired from a weapon barrel. The cartridge has a cartridge case including a metal bottom having an externally exposed outer face; and an electronic unit disposed in the cartridge case. The electric contact assembly includes a first contact arrangement for establishing an electric connection between the electronic unit and an evaluating and control apparatus situated externally of the cartridge. The first contact arrangement includes a contact ring disposed in the cartridge bottom and surrounding the longitudinal axis of the cartridge. The contact ring has an outer face which is approximately flush with the outer face of the cartridge bottom. An insulation electrically insulates the contact ring from cartridge bottom. A second contact arrangement establishes an electric connection between the electronic unit and the evaluating and control apparatus. A switching arrangement is connected between the contact ring and the second contact arrangement for maintaining a low ohmic-resistance connection between the contact ring and the second contact arrangement as long as a voltage applied to the contact ring and/or a current flowing through the switching arrangement remains below a predetermined minimum magnitude.

18 Claims, 2 Drawing Sheets

ELECTRIC CONTACT ASSEMBLY FOR A CARTRIDGE TO BE FIRED FROM A WEAPON BARREL

CROSS REFERENCE TO RELATED APPLICATION

This application claims the priority of German Application No. 198 53 290.3 filed Nov. 19, 1998, which is incorporated herein by reference.

BACKGROUND OF THE INVENTION

This invention relates to a cartridge which is adapted to be fired from a large-caliber weapon and which has a cartridge case accommodating at least one electronic unit coupled by means of at least two electric connectors with an electronic evaluating and control apparatus of the weapon. At least one of the electric connectors is coupled with the electronic unit by means of a contact disposed in an electrically insulated manner in the metal cartridge case bottom.

In known cartridges of the above-outlined type a connection between the electronic evaluating and control apparatus (for example, a fire control equipment) and the electronic unit situated inside the cartridge case is effected via the primer housing disposed in an insulated manner in the case bottom and via the cartridge case bottom electrically connected with the grounded weapon barrel. The electronic unit in the cartridge case may be humidity and/or temperature sensors as well as memories in which data characterizing the ammunition type are stored.

It is a disadvantage of the above-outlined cartridges that an electric contacting of the primer housing and conducting current therethrough is relatively complex and often a secure contacting cannot be achieved. Further, an electromagnetic compatibility in view of the outwardly exposed bottom of the primer housing is, as a rule, not ensured.

SUMMARY OF THE INVENTION

It is an object of the invention to provide an improved cartridge of the above-outlined type in which a simple and operationally safe contacting between the electronic evaluating and control apparatus and the electronic unit or units situated within the cartridge case is feasible.

This object and others to become apparent as the specification progresses, are accomplished by the invention, according to which, briefly stated, the electric contact assembly is combined with a cartridge to be fired from a weapon barrel. The cartridge has a cartridge case including a metal bottom having an externally exposed outer face; and an electronic unit disposed in the cartridge case. The electric contact assembly includes a first contact arrangement for establishing an electric connection between the electronic unit and an evaluating and control apparatus situated externally of the cartridge. The first contact arrangement includes a contact ring disposed in the case bottom and surrounds the longitudinal axis of the cartridge. The contact ring has an outer face which is approximately flush with the outer face of the case bottom. An insulation electrically insulates the contact ring from the case bottom. A second contact arrangement establishes an electric connection between the electronic unit and the evaluating and control apparatus. A switching arrangement is connected between the contact ring and the second contact arrangement for maintaining a low ohmic-resistance connection between the contact ring and the second contact arrangement as long as a voltage applied to the contact ring and/or a current flowing through the switching arrangement remains below a predetermined minimum magnitude.

The invention is essentially based on the principle that instead of providing an electric contact via the primer housing of the cartridge, a separate contact ring is utilized which is accessible from the outside. To ensure that in case of such a contact ring arrangement the electromagnetic compatibility of the cartridge is observed, in the cartridge case between the contact ring and a second electric connection (which, as a rule is the grounded cartridge case bottom) at least one switching element is disposed which provides for a low ohmic-resistance connection between the contact ring and the second electric connection in case the voltage applied to the contact ring and/or the current flowing through the switching element falls below a predetermined minimum magnitude. Such a switching element may be, for example, a PTC-resistor (a resistor having a positive temperature coefficient) or a Zener-diode.

As an alternative to the low ohmic-resistance connection between the contact ring and the second electric connection, in the cartridge case between the contact ring and the electronic units a switching device is arranged which is connected with a voltage monitoring circuit and which connects the contact ring with the electronic unit only if on the contact ring a minimum potential is present and/or if the voltage is present for a minimum duration.

According to a further feature of the invention, in the case bottom of the cartridge at least one magnetic field sensor is arranged which is connected with the switching device. The latter, in turn, is designed such that it connects the contact ring with the electronic unit only if the breechblock of the weapon is closed, that is, when the magnetic field sensor, because of the closing of the breechblock, has generated a corresponding control signal that is applied to the switching device.

It has been found advantageous to arrange the magnetic field sensor directly at the contact ring and the switching device in the cartridge case.

DESCRIPTION OF THE PREFERRED EMBODIMENTS

Figure 1:
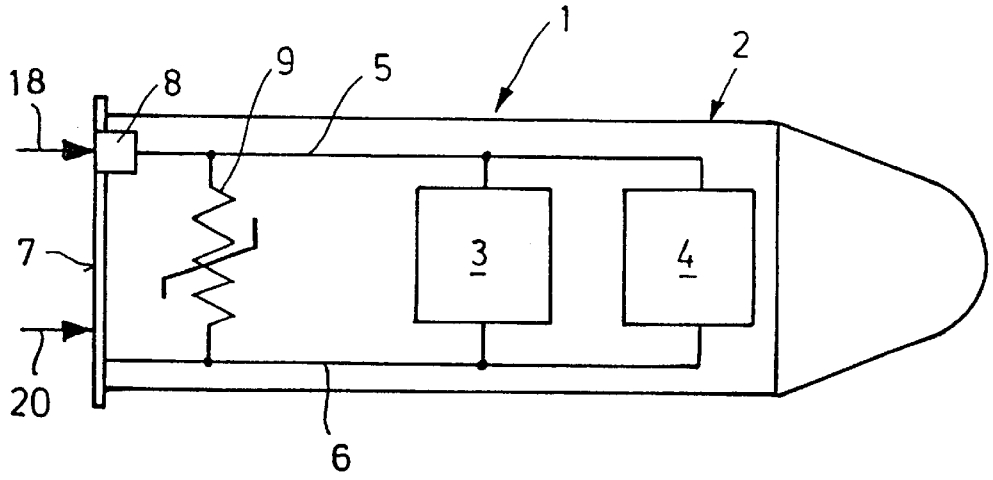
FIG. 1 is a schematic axial view, with block diagram, of a preferred embodiment of the invention.
Figure 3:
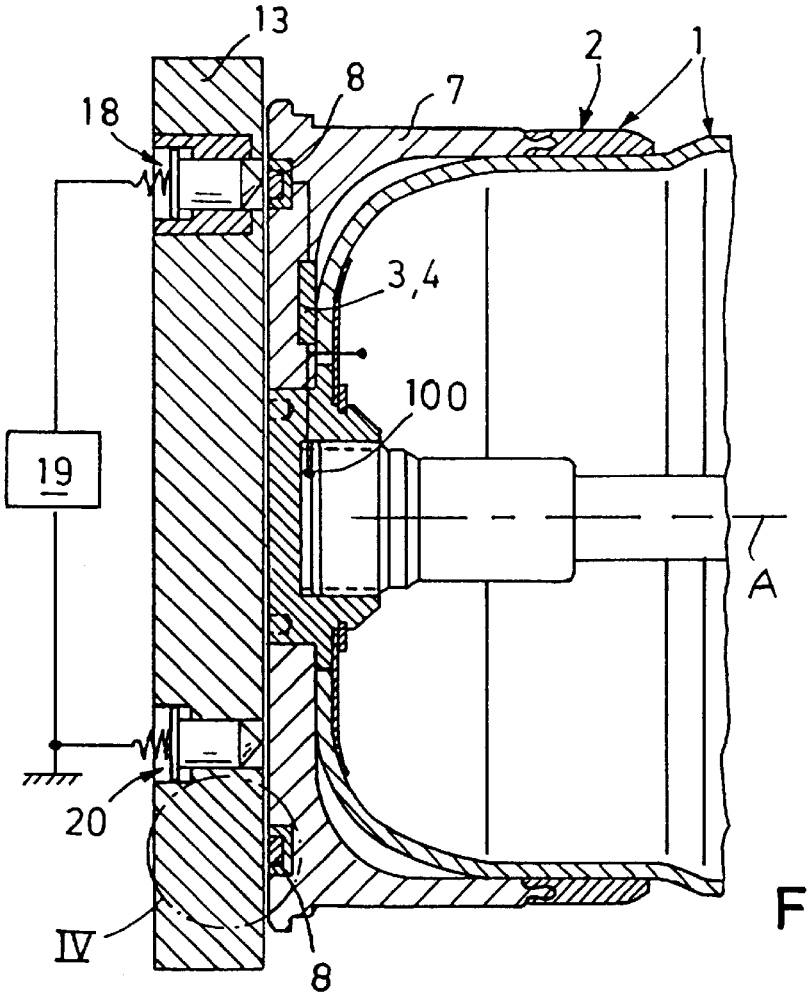
FIG. 3 is an axial sectional view of the case bottom region of a cartridge, also showing a breechblock of the weapon in the closed position.

FIG. 1 shows a cartridge 1 to be fired, for example, from a tank weapon. In the cartridge case 2 of the weapon 1 two electronic units 3 and 4 are arranged which may be, for example, an electronic unit for determining the humidity and temperature of the propellant powder and an electronic primer circuit. The two electronic units 3 and 4 are connected by two electric conductors 5 and 6 with a contact ring 8 disposed in an electrically insulated manner in the steel cartridge bottom 7 of the cartridge 1 and with the grounded cartridge bottom 7. The contact ring 8, as shown in FIG. 3, surrounds the longitudinal axis A of the cartridge 1. The electric conductors 5 and 6 also serve as conductors for transmitting information.

Between the contact ring 8 and the ground a temperature-dependent resistor 9 having a positive temperature coefficient (PTC-resistor) is arranged. The resistor 9 serves, during storage of the cartridge 1 or during its transport, as a low ohmic-resistance connection between the contact ring 8 and the ground and thus provides a superior protection against parasite currents and also enhances the electromagnetic compatibility.

The PTC-resistor assumes a high ohmic resistance only if a higher voltage is applied and thus the required supply current is caused to flow, to thus effect a switch-on of the electronic units 3 and 4. Since the PTC-resistor 9 operates with a designed delay, such a circuit takes into consideration particularly short-period interferences.

Figure 2:
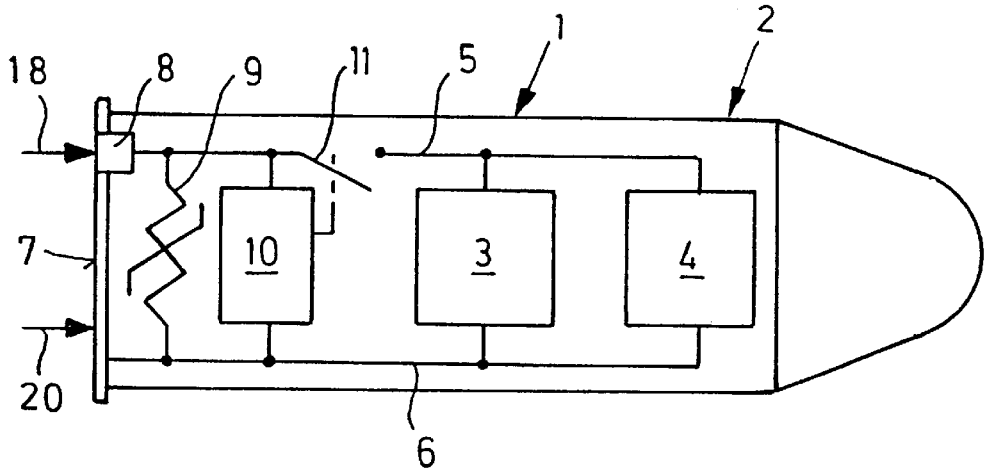
FIG. 2 is a schematic axial view, with block diagram, of another preferred embodiment of the invention.

The FIG. 1 structure is complemented in the FIG. 2 construction by the provision of a switching device 11 connected to a voltage monitoring circuit 10 and between the contact ring 8 and the electronic units 3 and 4. The switching device 11 may be an electronic switch or a mechanical relay.

The switching device 11 connects the contact ring 8 with the electronic units 3 and 4 only when to contact ring 8 a minimum voltage is applied or such a voltage lasts for a minimum predetermined duration. In this manner an improved protection from undesired external electric influences is achieved because as long as the switching device 11 is not actuated, the electronic units 3 and 4 remain completely disconnected from the contact ring 8. It is noted that the components 11, 12 may be provided as an alternative to the PTC-resistor 9.

In the embodiment shown in FIG. 2, additionally at least one magnetic field sensor 12 may be arranged preferably in the region of the contact ring 8 on or in the cartridge bottom 7. The magnetic field sensor 12 too, is connected with the switching device 11. After loading the cartridge in a weapon barrel, upon closing the breechblock 13 made of a magnetically conducting material (steel), a corresponding switching signal is generated which affects the switching device 11 so that only at that moment is the contact ring 8 electrically connected with the electronic units 3, 4.

As shown in FIG. 3, the electronic units 3 and 4 may be integrated in a joint chip which is positioned in a suitable recess of the cartridge case bottom 7 and which is connected with the primer 100 of the cartridge 1.

Figure 4:
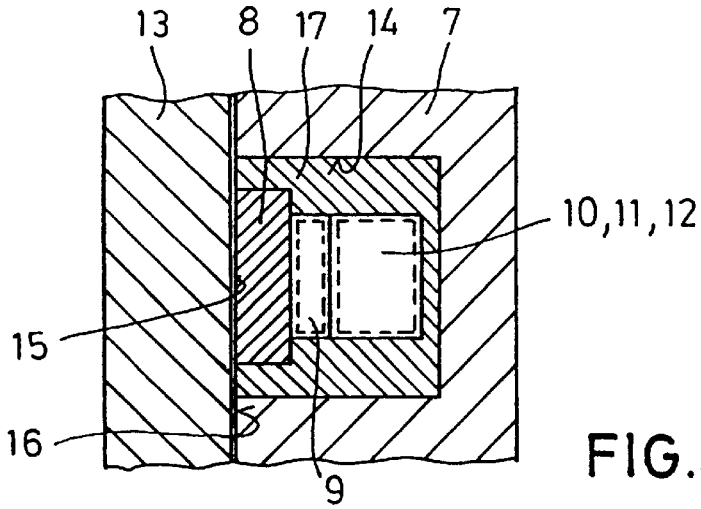
FIG. 4 is an enlarged sectional view of the inset shown at IV in FIG. 3.

Turning to FIG. 4, the contact ring 8 is positioned in a groove 14 of the cartridge bottom 7 such that its outer face 15 is at least approximately flush with the outer face 16 of the case bottom 7. Further, the contact ring 8 is arranged within the groove 14 in an insulated manner by virtue of an insulating thimble 17. The PTC-resistor 9, the voltage monitoring circuit 10, the switching device 11 as well as the magnetic field sensor 12 together with an integrated magnet are disposed within the groove 14 on that side of the contact ring 8 which is opposite from the outer face 15.

The contact ring 8 is contacted by a first contact member 18 which is supported in the breechblock 13 in an electrically insulated manner and which is displaceable parallel to the longitudinal weapon barrel axis. The contact member 18 is connected with an evaluating and control apparatus 19 (such as a fire control equipment) of the weapon.

The earlier-described second electric connection is effected in the described embodiment by means of second contact member 20 which is likewise displaceable parallel to the axis of the weapon barrel but which is not insulated electrically from the breechblock 13.

It will be understood that the invention is not limited to the above-described embodiments. Thus, for example, the closed breechblock may be detected by means of two or more magnetic field sensors provided in the cartridge case bottom. The magnetic field sensors are not necessarily disposed in the groove for the contact ring but may be accommodated in separately provided recesses.

If required, the second electric connection between the cartridge and the evaluating and control apparatus may be connected with an electrically insulated conductor instead of being grounded. For this purpose, the contact member 20 is configured like the contact member 18 and in the region of the case bottom which is contacted by the contact member 20, an additional contact ring corresponding to the contact ring 8 is provided in an electrically insulated manner.

It will be understood that the above description of the present invention is susceptible to various modifications, changes and adaptations, and the same are intended to be comprehended within the meaning and range of equivalents of the appended claims.

What is claimed is:

1. An electric contact assembly in combination with a cartridge to be fired from a weapon barrel; said cartridge comprising (a) a longitudinal axis;

(b) a cartridge case including a metal bottom having an externally exposed outer face; and (c) an electronic unit disposed in said cartridge case;

said electric contact assembly comprising (a) a first contact arrangement for establishing an electric connection between said electronic unit and an evaluating and control apparatus situated externally of said cartridge; said first contact arrangement including (1) a contact ring disposed in said bottom and surrounding said axis; said contact ring having an outer face being approximately flush with said outer face of said bottom; and (2) an insulation electrically insulating said contact ring from said bottom;

(b) a second contact arrangement for establishing an electric connection between said electronic unit and the evaluating and control apparatus; and (c) switching means connected between said contact ring and said second contact arrangement for maintaining a low ohmic-resistance connection between said contact ring and said second contact arrangement as long as one of a voltage applied to said contact ring and a current flowing through said switching means remains below a predetermined minimum magnitude.

2. The electric contact assembly as defined in claim 1, wherein said switching means comprises a Zener diode.

3. The electric contact assembly as defined in claim 1, further comprising a recess provided in said bottom;

said switching means being positioned in said recess.

4. The electric contact assembly as defined in claim 1, wherein said switching means comprises a PTC-resistor.

5. The electric contact assembly as defined in claim 1, wherein said second contact arrangement includes said bottom.

6. The electric contact assembly as defined in claim 1, wherein said switching means is a first switching means; further comprising a second switching means connected between said contact ring and said electronic unit for establishing an electric connection between said contact ring and said electronic unit only if one of a voltage applied to said contact ring and a duration of a voltage applied to said contact ring exceeds a minimum value.

7. The electric contact assembly as defined in claim 6, wherein said second switching means comprises (a) a voltage monitoring circuit; and (b) a switch connected to said voltage monitoring circuit and having an open state in which electric connection between said contact ring and said electronic unit is interrupted and a closed state in which electric connection between said contact ring and said electronic unit is maintained.

8. The electric contact assembly as defined in claim 7, further comprising a recess provided in said bottom; said switch being positioned in said recess.

9. The electric contact assembly as defined in claim 7, further comprising a recess provided in said bottom; said voltage monitoring circuit being positioned in said recess.

10. The electric contact assembly as defined in claim 7, further comprising a magnetic field sensor positioned in said bottom and connected with said switch; said switch being placeable into said closed state solely in response to a signal emitted by said magnetic field sensor upon closing of a weapon breechblock on the cartridge.

11. The electric contact assembly as defined in claim 10, further comprising a groove provided in said outer face of said bottom; said contact ring and said magnetic field sensor being positioned in said groove.

12. An electric contact assembly in combination with a cartridge to be fired from a weapon barrel; said cartridge comprising (a) a longitudinal axis;

(b) a cartridge case including a metal bottom having an externally exposed outer face; and (c) an electronic unit disposed in said cartridge case;

said electric contact assembly comprising (a) a first contact arrangement for establishing an electric connection between said electronic unit and an evaluating and control apparatus situated externally of said cartridge; said first contact arrangement including (1) a contact ring disposed in said bot tom and surrounding said axis; said contact ring having an outer face being approximately flush with said outer face of said bottom; and (2) an insulation electrically insulating said contact ring from said bottom;

(b) a second contact arrangement for establishing an electric connection between said electronic unit and the evaluating and control apparatus; and (c) switching means connected between said contact ring and said electronic unit for establishing an electric connection between said contact ring and said electronic unit only if one of a voltage applied to said contact ring and a duration of a voltage applied to said contact ring exceeds a minimum value.

13. The electric contact assembly as defined in claim 12, wherein said switching means comprises (a) a voltage monitoring circuit; and (b) a switch connected to said voltage monitoring circuit and having an open state in which electric connection between said contact ring and said electronic unit is interrupted and a closed state in which electric connection between said contact ring and said electronic unit is maintained.

14. The electric contact assembly as defined in claim 12, wherein said second contact arrangement includes said bottom.

15. The electric contact assembly as defined in claim 13, further comprising a recess provided in said bottom; said switch being positioned in said recess.

16. The electric contact assembly as defined in claim 13, further comprising a recess provided in said bottom; said voltage monitoring circuit being positioned in said recess.

17. The electric contact assembly as defined in claim 13, further comprising a magnetic field sensor positioned in said bottom and connected with said switch; said switch being placeable into said closed state solely in response to a signal emitted by said magnetic field sensor upon closing of a weapon breechblock on the cartridge.

18. The electric contact assembly as defined in claim 17, further comprising a groove provided in said outer face of said bottom; said contact ring and said magnetic field sensor being positioned in said groove.

* * * * *